US010113806B2

(12) United States Patent
Brenner et al.

(10) Patent No.: US 10,113,806 B2
(45) Date of Patent: Oct. 30, 2018

(54) HEAT EXCHANGER, IN PARTICULAR BLOCK-IN-SHELL HEAT EXCHANGER COMPRISING A SEPARATING UNIT FOR SEPARATING A GASEOUS PHASE FROM A LIQUID PHASE AND FOR DISTRIBUTING THE LIQUID PHASE

(71) Applicant: LINDE AKTIENGESELLSCHAFT, Munich (DE)

(72) Inventors: Steffen Brenner, Trostberg (DE); Stefan Kayser, Trostberg (DE); Paul Raymond Davies, Katy, TX (US)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/534,542

(22) PCT Filed: Dec. 7, 2015

(86) PCT No.: PCT/EP2015/002463
§ 371 (c)(1),
(2) Date: Jun. 9, 2017

(87) PCT Pub. No.: WO2016/102047
PCT Pub. Date: Jun. 30, 2016

(65) Prior Publication Data

US 2017/0363360 A1 Dec. 21, 2017

(30) Foreign Application Priority Data

Dec. 23, 2014 (EP) ..... 14004381

(51) Int. Cl.
*F28D 7/00* (2006.01)
*F28D 9/00* (2006.01)
(Continued)

(52) U.S. Cl.
CPC ..... *F28D 9/0006* (2013.01); *F28D 21/0017* (2013.01); *F28F 9/026* (2013.01);
(Continued)

(58) Field of Classification Search
CPC ..... F28D 9/0006; F28D 21/0017; F28D 2021/0064; F28F 9/026; F25B 39/00; F25B 2339/0241; F25B 41/00; B60H 1/2218
(Continued)

(56) References Cited

U.S. PATENT DOCUMENTS 6,158,238 A 12/2000 Lampinen et al.
2007/0095097 A1* 5/2007 Cowans ..... F25B 41/00 62/512
(Continued)

FOREIGN PATENT DOCUMENTS

EP 1085285 A2 3/2001

*Primary Examiner* — Davis Hwu
(74) *Attorney, Agent, or Firm* — Millen White Zelano & Branigan, PC; Brion Heaney

(57) ABSTRACT

An apparatus for the treatment of infections associated with respiratory disorders in a mammal with a mixture for use as an inhalable medicament. The apparatus includes a patient interface, at least one source of helium for providing gaseous helium, at least one source of oxygen for providing gaseous oxygen, an application device for providing a mixture to the patient interface, at least one source of nitric oxide for providing gaseous nitric oxide, a gas injector for injecting the nitric oxide into the mixture, an injector for injecting a means for inhibiting growth of pulmonary pathogens, a controller programmed for controlling the gas injector, the application device and the injector.

15 Claims, 4 Drawing Sheets

(51) Int. Cl.
*F28D 21/00* (2006.01)
*F28F 9/02* (2006.01)
*F25B 39/00* (2006.01)

(52) U.S. Cl.
CPC ..... *F25B 39/00* (2013.01); *F25B 2339/0241* (2013.01); *F28D 2021/0064* (2013.01)

(58) Field of Classification Search
USPC ..... 165/160
See application file for complete search history.

(56) References Cited

U.S. PATENT DOCUMENTS

| | | | | |
|---|---|---|---|---|
| 2013/0055751 | A1* | 3/2013 | Inaba ..... | B60H 1/2218 62/498 |
| 2013/0319039 | A1 | 12/2013 | Sonninen et al. | |
| 2015/0153115 | A1 | 6/2015 | Kayser et al. | |

* cited by examiner

HEAT EXCHANGER, IN PARTICULAR BLOCK-IN-SHELL HEAT EXCHANGER COMPRISING A SEPARATING UNIT FOR SEPARATING A GASEOUS PHASE FROM A LIQUID PHASE AND FOR DISTRIBUTING THE LIQUID PHASE

The invention relates to a heat exchanger for indirectly exchanging heat between a first medium and a second medium, in particular in the form of a so-called block-in-shell heat exchanger (also commonly known as a core-in-shell or block-in-kettle heat exchanger).

It is known in the prior art to use a tank in which there is arranged at least one plate heat exchanger that is flowed through by a second medium, the medium to be cooled. The plate heat exchanger is in this case located in a bath of a liquid phase of the first medium. On account of the heat entering it from the second medium, to be cooled, the first medium, which is becoming warmer (and usually also partially evaporating), rises up in the plate heat exchanger (thermosiphon effect). The first medium, for cooling, is in this case generally fed into the tank as a two-phase fluid, comprising a liquid phase and a gaseous phase, it being disadvantageous that the gaseous phase can at least partially enter the coolant bath in the region of the plate heat exchanger. This takes place in particular at high inflow rates of the two-phase first medium. If gaseous fluid enters a plate heat exchanger from below, the thermosiphon effect is (disadvantageously) influenced. Moreover, blocking bubbles may cause a discontinuous inflow into the plate heat exchanger (from below).

Figure 1:
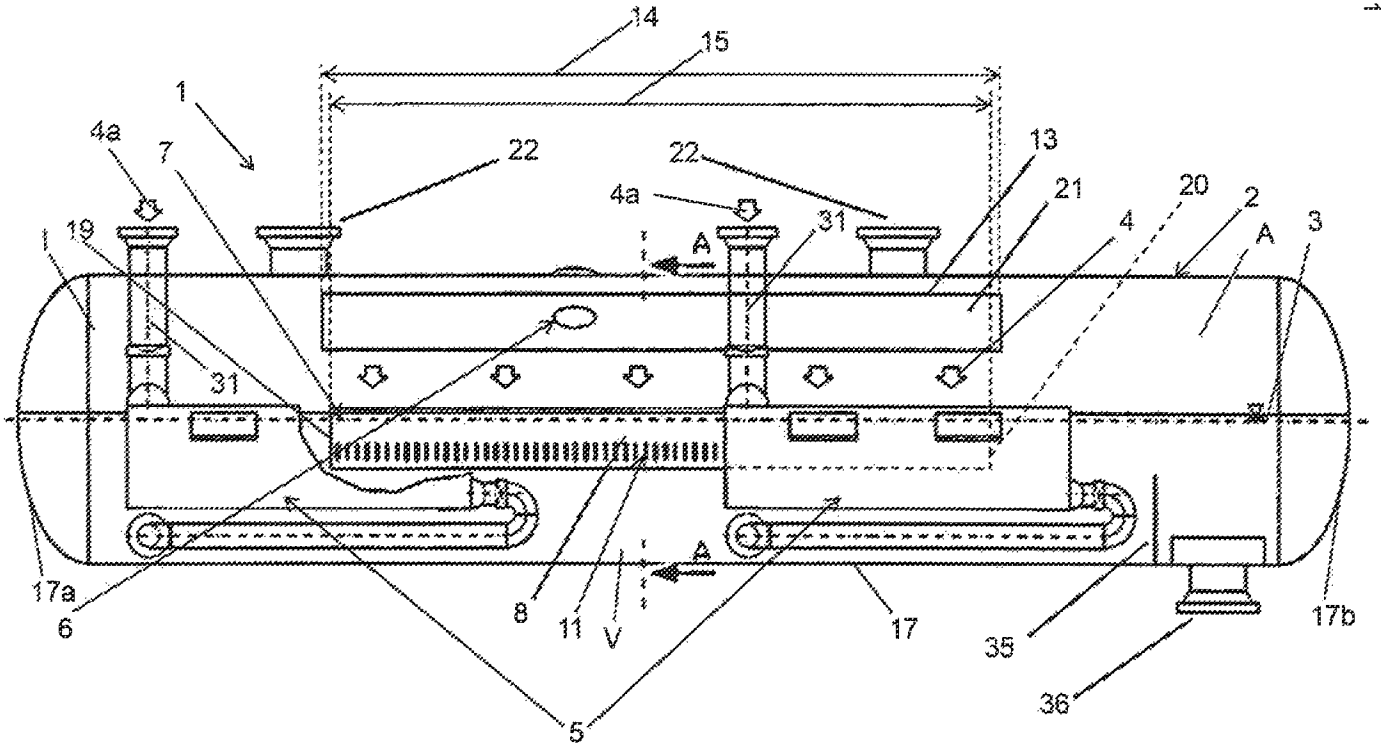

Heat exchangers of the type mentioned at the beginning are described for example in "The standards of the brazed aluminium plate-thin heat exchanger manufacturers' association (ALPEMA)", third edition, 2010, page 67 in FIG. 9-1. Such heat exchangers have a tank or shell ("shell" or "kettle"), which encloses a shell space or inner space, and also at least one plate heat exchanger arranged in the shell space or inner space ("core" or "block"). Such a configuration of a heat exchanger is therefore also known as a "core-in-shell" or "block-in-kettle" heat exchanger.

Against this background, the present invention is based on the object of at least partially overcoming the disadvantages known from the prior art. The measures according to the invention and, advantageous refinements thereof are described below. The features of the invention may be combined in any technically meaningful way, it also being possible to use for this the explanations from the following description and features from the figures, which cover additional refinements of the invention.

This object is achieved by a heat exchanger with the features as discussed herein.

It accordingly proposes a heat exchanger, comprising a tank, which has an inner space for receiving the two-phase first medium, a plate heat exchanger arranged in the inner space, for indirectly exchanging heat between the first medium and the second medium, the inner space being designed to receive the first medium with a filling height such that a liquid phase of the first medium forms a bath surrounding the heat exchanger, and an inlet for introducing the first medium into the inner space, wherein according to the invention a separating unit forming a receiving space is provided in the inner space for separating the gaseous phase to the greatest extent from the liquid phase of the first medium before the liquid phase is fed to the collecting space, the separating unit having at least one upwardly directed receiving opening for introducing into the receiving space first medium falling down in the inner space, and the upwardly directed receiving opening being arranged above or at the filling height, so that the gaseous phase of the first medium that is received in the receiving space can escape via the receiving opening into the inner space or separating space, and furthermore a distributor that is in flow connection with the inlet and is arranged vertically above the receiving opening and also above the filling height being provided in the inner space, the distributor being designed to distribute the first medium over the receiving opening.

The separating space is that part of the inner space that is located above the liquid level in the inner space and is correspondingly available for receiving the gaseous phase of the first medium.

The arrangement of the receiving opening does not necessarily have to be referred to the filling height, but may alternatively or additionally also be referred to an upper side or upper edge of the plate heat exchanger or of the plate heat exchanger block. Preferably, in this respect an upper edge (referred to the vertical) of the receiving opening is preferably in the range of 0 mm to 100 mm, particularly preferably in the range of 0 mm to 50 mm, more particularly preferably in the range of 0 mm to 25 mm above the upper side or upper edge of the plate heat exchanger, the value 0 mm corresponding to the level of the upper side or the upper edge of the plate heat exchanger in the direction of the vertical.

According to the invention, the separating unit serves in particular for removing the remaining amount of gas from the liquid, in order that as far as possible no gas enters the collecting space (as a result of the inflow of the inlet stream into the tank). Consequently, the separating unit differs from other separators (for example the separating space of the shell, the distributor channel at the inlet to the pre-separation, etc.). Furthermore, the separating unit can also be advantageously used for distributing the liquid in the tank, to be specific in particular whenever for example resistance elements (for example weirs or perforated separating walls) are installed in the shell space (inner space) of the heat exchanger and impede/hinder the distribution.

According to a preferred embodiment, it is provided that the separating unit has a first side wall, facing the inner space. In this case, the first side wall may have at least one distributing opening, the at least one distributing opening preferably being arranged at least partially under the filling height, so that the liquid phase of the first medium can be introduced by way of the at least one distributing opening into the bath surrounding the plate heat exchanger. Preferably, a number of such distributing openings are formed in the first side wall.

As an alternative to this, the first side wall may however also be formed as an overflow wall. The first side wall is then made liquid-impermeable, i.e. it does not have any distributing openings, so that the liquid phase of the first medium can possibly flow over an upper edge of the first side wall into the collecting space. The collecting space is in this case that region of the inner space that can accept or accepts the bath formed from the liquid phase of the first medium.

In other words, the separating unit may be configured both as an overflow pocket and as a (liquid-)permeable pocket, i.e. the position and direction of the liquid outlet is in particular freely selectable.

The separating unit extends in particular along a longitudinal axis of the tank (that is horizontal during operation) and is formed for example as an upwardly open (receiving opening) channel, the first side wall of which, facing the inner space, possibly having the said at least one distributing opening.

The said filling height should be understood in particular as meaning a desired height at which the liquid level of the liquid phase of the first medium is located during the operation of the heat exchanger as intended. During operation as intended, the plate heat exchanger may be completely immersed in the bath formed by the liquid phase of the first medium, but may also protrude out of the bath with its upper side.

The filling height preferably lies with reference to the upper side (or upper edge) of the plate heat exchanger in a range of −500 mm to +100 mm, particularly preferably in a range of −300 mm to +100 mm, more preferably in the range of −300 mm to +50 mm, still more preferably in the range of −300 mm to +25 mm, still more preferably in the range of −300 mm to 0 mm. Here, the value 0 mm corresponds to the level of the upper side (see above). Negative values indicate that the filling height lies below the upper side/upper edge of the plate heat exchanger in the direction of the vertical.

Where mention is made here of an upper side or upper edge of the plate heat exchanger, this means in particular the horizontal (in particular planar) upper side or upper edge of the plate heat exchanger block, which is defined in particular by the separating walls, side bars and fins. The manifolds and nozzles or pipes connected thereto do not form part of this surface of the plate heat exchanger.

The tank of the heat exchanger may have a cylindrical shell (that is horizontal during operation), which is made to extend along a longitudinal axis, and also terminating (curved) end plates at both ends of the cylindrical shell.

The heat exchanger has on the shell an inlet through which the (usually) two-phase fluid can enter the tank. The inlet is provided in particular above the filling height. Consequently, the two-phase fluid flows substantially from the top downward between the inlet and the filling height or, in the presence of a distributor (see below), between the distributor and the filling height. This has the effect that part of the gas phase of the two-phase fluid is already separated here before the residual/remaining fluid enters the bath in the so-called collecting space below or at the filling height.

However, this separation is insufficient in particular in the case of high flow rates at the inlet. Furthermore, gas from the separating space can enter the bath when the liquid impinges on the surface of the bath.

It is therefore proposed here to arrange between the filling height and the inlet or between the filling height and a distributor (see below) a separating unit that forms at least one receiving space for the two-phase fluid. Only a single separating unit is described in its function below for the sake of better illustration, while not representing any restriction of the number that is possible or preferred. In particular, a number of separating units may also be arranged within the tank, aligned and arranged in the direction of the longitudinal axis of the tank, it being possible for an inlet to be respectively assigned a separating unit.

The separating unit forms at least one upwardly open or directed receiving opening, by way of which the two-phase first medium entering the inner space of the tank from the inlet can enter the receiving space of the separating unit. The receiving opening is in this case preferably located above the filling height, so that gas that has been separated or is being separated can leave the receiving space in the upward direction and not enter the liquid bath by way of the at least one distributing opening of the first side wall of the separating unit. Generally, the first side wall has a number of distributing openings for letting the liquid phase of the first medium out of the receiving space.

The separating unit achieves the effect that the rate at which the liquid phase of the first medium enters the coolant bath is reduced. In the separating unit, entrained gas or entrained gas bubbles has/have sufficient time to be induced by their buoyancy to leave by way of the receiving opening of the separating unit into the separating space before they could enter the bath by way of the possibly present distributing openings.

The separating unit is preferably produced from metal sheets (that are in particular planar). The separating unit may also be produced for example from worked tubes, worked solid materials, castings or (extruded) sections or a suitable combination of such materials.

The separating unit may both be open upwardly (i.e. toward the separating space) over the entire length and have upwardly closed portions (in the closed portions there is no flow of liquid to the separating unit). Furthermore, the separating unit may extend along the longitudinal axis of the shell or tank both over the entire region of the inner space of the tank and only over selected regions.

As already explained, also preferably provided is a distributor that is in flow connection with the inlet and has at least one downwardly directed outlet opening, preferably a number of downwardly directed outlet openings. The distributor or its outlet openings is/are preferably arranged above the separating unit and vertically above the filling height (referred to the heat exchanger arranged as intended or in operation). With such a distributor, a flow of the two-phase first medium can take place over an entire length of the separating unit or receiving opening along the longitudinal axis of the tank. The separating unit and possibly the distributor preferably form channels that extend in the direction of the longitudinal axis of the tank. The distributor and the separating unit are preferably also of the same length along the longitudinal axis.

The distributor has the effect of already bringing about a first reduction in the rate of entry of the first medium, so that a pre-separation, i.e. a coarse separation of gas phase and the liquid phase, is already achieved here. In addition, the incident flow is distributed over a greater length by means of the distributor, so that an inlet with a small cross section, and consequently high flow velocities, can be used without these high velocities being transferred into the tank.

The distributor, or its at least one outlet opening, is preferably arranged perpendicularly above the receiving opening of the separating unit, so that the first medium can flow off through the receiving opening into the receiving space of the separating unit.

According to a further advantageous embodiment of the heat exchanger, the separating unit has a second side wall, which lies opposite the first side wall and is preferably formed by a wall of the tank or shell of the tank. The separating unit is therefore in other words set against an inner side of the shell of the tank. The second side wall may however also be formed separately from the shell.

The use of the wall of the tank as a second side wall for the separating unit allows the receiving space to be created while using particularly little material. The separating unit is advantageously welded, adhesively attached or in some other way positively or non-positively joined onto the wall of the tank by its own second side wall or by the second side wall that is formed from the wall of the tank. Apart from on the shell, the separating unit may also be attached at another suitable location (for example on the plate heat exchanger). The side walls of the separating unit are preferably provided as sheet-metal parts.

According to a further advantageous embodiment of the heat exchanger, the separating unit also comprises a third and a fourth side wall, which in particular form end faces of the longitudinally extended separating unit. The third and fourth side walls respectively connect the first side wall to the second side wall, the third and fourth side walls preferably running perpendicularly to the longitudinal axis of the tank. The third and fourth side walls preferably have in each case at least one side opening. The side openings are formed for example as circular holes.

An upper edge of the separating unit preferably lies above the filling height, so that the liquid phase can only get into the bath in the collecting space through the distributing openings—if present—(and possibly further openings in the side walls of the separating unit).

According to one embodiment, the side walls of the separating unit completely divide off the receiving space from the liquid bath in the collecting space, i.e. the liquid phase of the first medium only enters the liquid bath in the collecting space by way of the receiving space of the separating unit. The impulse or the kinetic energy of the falling first medium is reduced in the receiving space. Gas bubbles can rise up and enter the separating space by way of the receiving opening. The entry of gas bubbles into the collecting space or into the first heat exchanging passages of the plate heat exchanger is thereby avoided. In the region of the lower inlet openings of the plate heat exchanger into the vertical heat exchanging passages, the liquid flow of the first medium is not adversely influenced by the inlet flow.

In an alternative embodiment, no third and fourth side walls are provided and the receiving space is consequently open at the end faces. It is also possible for third and fourth side walls of which the upper edges lie below the filling height to be provided.

Preferably, the separating unit is arranged laterally in relation to the heat exchanger, in a horizontal direction running perpendicularly to the longitudinal axis of the tank, and extends along (in particular parallel to) the heat exchanger or the longitudinal axis of the tank.

In a further embodiment of the invention, it is also conceivable to fix the separating unit on the heat exchanger itself. In this case, it is possible to dispense with fastening of the separating unit on the shell of the tank.

According to a further advantageous embodiment of the heat exchanger, the first side wall is inclined in the direction of the plate heat exchanger, that is to say toward the inner space. The liquid phase of the first medium can therefore correspondingly also leave the receiving space downward in the vertical direction through the distributing openings. The first side wall may form an angle here with the vertical in the range of 15° to 75°. Preferably, the angle of inclination of the first side wall is about 45°.

The alignment of the first side wall as a side wall that is inclined in relation to the vertical has the effect of saving material in comparison with a rectangular box shape, because the receiving space can be completely bounded by the first side wall, the second side wall and also possibly the third and fourth side walls. In addition, a rapid rise in the filling level within the receiving space is achieved during an initial incident flow with the two-phase first medium.

According to a further advantageous embodiment of the heat exchanger, the at least one distributing opening is formed as a slit. The slit-shaped form of the distributing openings means that a relatively large surface area through which a flow can pass is achieved for each opening. A longitudinal extent of such slits in this case preferably runs along the vertical. That is to say that a slit-shaped distributing opening has a lower edge and a parallel upper edge, which are significantly shorter than the two parallel side edges of the distributing opening that extend between the lower edge and the upper edge. In principle, the type and position of the openings (extent of slit longitudinally or transversely, circular opening, etc.) can be chosen on the basis of various aspects (for example horizontal and vertical extent, production expenditure, etc.). This applies to all of the side walls.

The separating unit may be produced from all suitable materials (such as for example aluminum, steel or plastic). A combination of suitable materials is also possible. The shape, size and number of the elements of a separating unit that are used may be dictated both by production-related aspects and process-related aspects. Allowance may also be made here for particular installation-specific features. Each of the elements used may be individually designed. The elements of the separating unit may be solid, perforated or else slit. For example, metal sheets that are used may be both flat and profiled.

According to a preferred embodiment of the heat exchanger, at least the first side wall and also the end side walls (third and fourth side walls) are formed from a metal sheet. Preferably planar metal sheets are used for this, in which possibly the said distributing openings and possibly side openings have been made.

In the case of this advantageous embodiment, the separating unit can be produced at particularly low cost and does not have the effect that the heat exchanger is made considerably more expensive than a previously known heat exchanger without a separating unit. The metal sheets may be connected to one another by all suitable connecting means, for example by means of welded connections or riveted connections, etc.

As already described, the heat exchanging unit arranged in the inner space of the heat exchanger is a plate heat exchanger. This has first heat exchanging passages for receiving the first medium and second heat exchanging passages for receiving the second medium, the heat exchanging passages being separated from one another by separating plates (for example separating metal sheets). Heat conducting structures are preferably respectively provided between adjacent separating plates, for example in the form of bent or corrugated metal sheets (so-called fins). The outermost layers of the plate heat exchanger may be formed by outer sheets. In this way, a multiplicity of parallel channels or a first or second heat exchanging passage through which an assigned medium or fluid can flow are formed between two separating plates in each case or between a separating plate and an outer sheet as a result of the heat conducting structure respectively arranged in between (for example a fin). The first and second heat exchanging passages are preferably arranged adjacent to one another, so that heat can be exchanged indirectly between the first and the second medium or fluid. The two media may be conducted for example in cross-flow, in counter-flow or else in cross-counter-flow in relation to one another in the assigned passages.

Terminating bars (so-called side bars) for closing off the respective heat exchanging passage are preferably provided to the sides, between two adjacent separating plates in each case. The first heat exchanging passages are open upwardly and downwardly (in the direction of the vertical) and in particular not closed off by terminating bars. Here, each first heat exchanging passage has on the underside of the plate heat exchanger an inlet opening (see above), by way of which the liquid phase of the first medium can pass into the first heat exchanging passages, and also an outlet opening on the upper side of the plate heat exchanger, by way of which the first medium can leave at the upper side of the plate heat exchanger as a two-phase stream. The outer sheets, separating plates, fins and side bars are preferably produced from aluminum and are preferably brazed to one another, for example in a furnace.

Furthermore, the plate heat exchanger preferably has a first manifold (also referred to as a header), which is in flow connection with the second heat exchanging passages, so that the second medium can be introduced into the second heat exchanging passages by way of the first manifold, and also a second manifold (or header), which is likewise in flow connection with the second heat exchanging passages, so that the second medium can be drawn off from the second heat exchanging passages by way of the second manifold.

In principle, it is also possible for a number of plate heat exchangers to be arranged in the inner space of the tank. Each plate heat exchanger may then for example be assigned a separating unit according to the invention and also possibly a distributor.

Part of the liquid of the first medium that is introduced into the collecting space by way of the separating unit flows downwardly in the vertical direction in the collecting space, then enters the plate heat exchanger or exchangers from below and is partially evaporated there. The other part flows in the horizontal direction into other regions of the collecting space. The flow of the liquid in the horizontal direction is disturbed, sometimes massively, by the installation of resistance elements (for example weirs or perforated separating walls) between the plate heat exchangers or next to a plate heat exchanger. To overcome each and every element, positive pressure is required, produced by an increased level of liquid upstream of the element.

This has the consequence that the spaces between the elements have different liquid levels, which can adversely influence the operation of the block-in-shell heat exchanger. This effect is further exacerbated to the extent that the positive pressure required for overcoming the element is a function of the volumetric flow. Here it is the case that the positive pressure must be all the higher the greater the volumetric flow is. The separating unit makes it possible to bypass the resistance elements for the distribution of the liquid phase of the first medium in the shell space.

According to a further embodiment of the heat exchanger according to the invention, it is provided that the heat exchanger has a conducting device which is arranged under the distributor and is designed for conducting the liquid phase of the first medium that is leaving the at least one outlet opening.

Preferably, the conducting device is in this case designed to conduct at least part of the liquid phase that has left the at least one outlet opening in a first spatial direction into a second spatial direction, the second spatial direction in particular being different from the first spatial direction, and the second spatial direction in particular having a greater horizontal component than the first spatial direction or pointing toward the shell of the tank. The first spatial direction runs in particular along the vertical.

Preferably, the conducting device is also designed to conduct the liquid phase of the first medium away from the upper side of the plate heat exchanger and/or past the upper side. Preferably, the conducting device is designed to conduct the liquid phase of the first medium such that the liquid phase does not impinge on the upper side of the plate heat exchanger.

Furthermore, the conducting device preferably has at least one plate-shaped conducting element, in particular in the form of a baffle.

In a further embodiment, the at least one conducting element preferably has a curvature. Here, the at least one conducting element has in particular a convexly curved first side, which is facing the plate heat exchanger, and also a concavely curved second side facing away from the first side, which is facing away from the plate heat exchanger and/or is facing the distributor channel. In this case, the at least one conducting element is in particular arranged such that the liquid phase of the first medium that is leaving the distributor downward through the at least one outlet opening of the distributor impinges on the second side and is guided along the latter away from the upper side of the plate heat exchanger and/or past this upper side. It is thereby ensured that the liquid phase does not impinge on the upper side of the plate heat exchanger and as a result under some circumstances adversely influence the operation of the plate heat exchanger.

Preferably, it is also provided that the conducting device extends over the entire distributor or just over a portion of the distributor.

Furthermore, the at least one conducting element may have a plurality of through-openings for the first medium.

Furthermore, the heat exchanger according to the invention as provided by one embodiment has a device for conducting/controlling the liquid phase that is arranged in the separating unit or in the receiving space of the separating unit. This device may for example have one (or more) of the following elements:

- a conducting element (for example a baffle) for deflecting and/or decelerating a flow of the liquid phase in the receiving space,
- a mesh, in particular a wire mesh, for decelerating a flow of the liquid phase and/or for assisting the agglomeration of gas bubbles of an entrained gaseous phase in the receiving space.

According to a further embodiment of the heat exchanger according to the invention, it is provided that the separating unit extends over more than half of the length of the shell of the tank (that is made to extend along the horizontal longitudinal axis), to be precise preferably over more than 80% of this length, more preferably over more than 90% of this length. The background here is in particular the fact that the separating unit can also be used for distributing the liquid phase in the shell space, for example when there are resistance elements installed in the shell space. The separating unit can then extend in the shell space over these elements. In this case, for example, the inlet into the shell space may for example be present only in one half of the shell, but the separating unit may extend over almost the entire length of the shell (see above).

Figure 2:
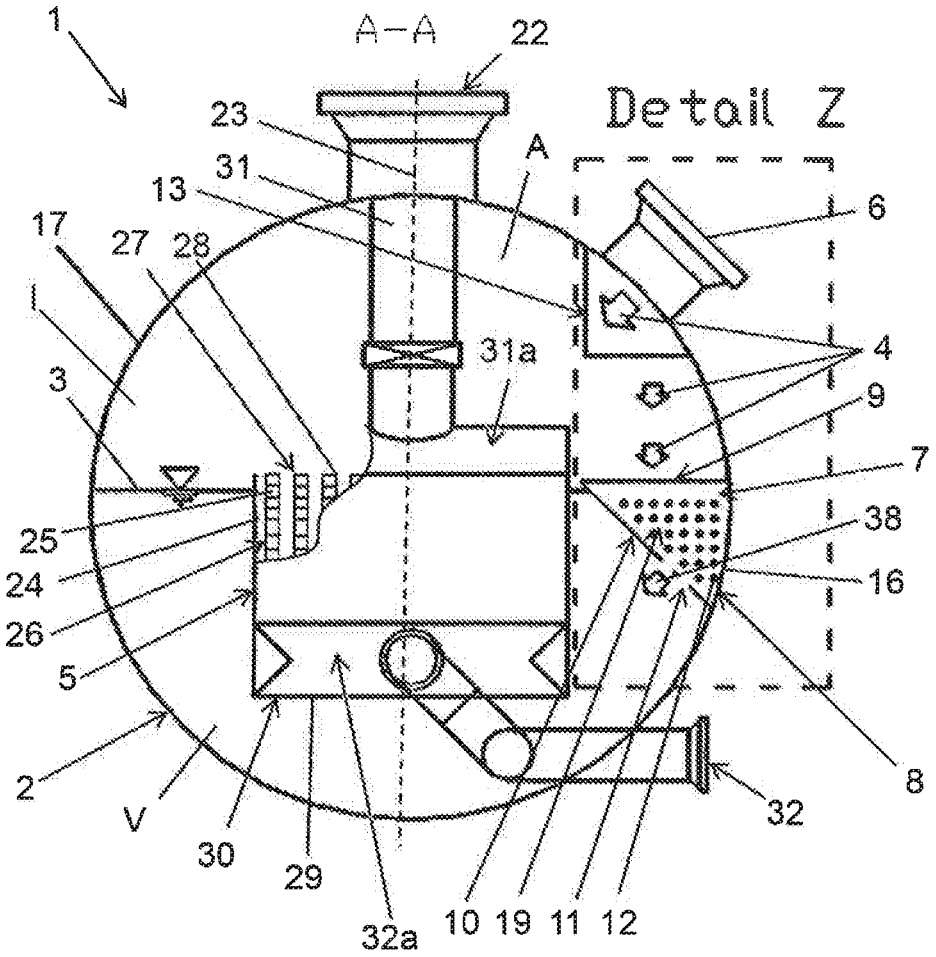
Figure 3:
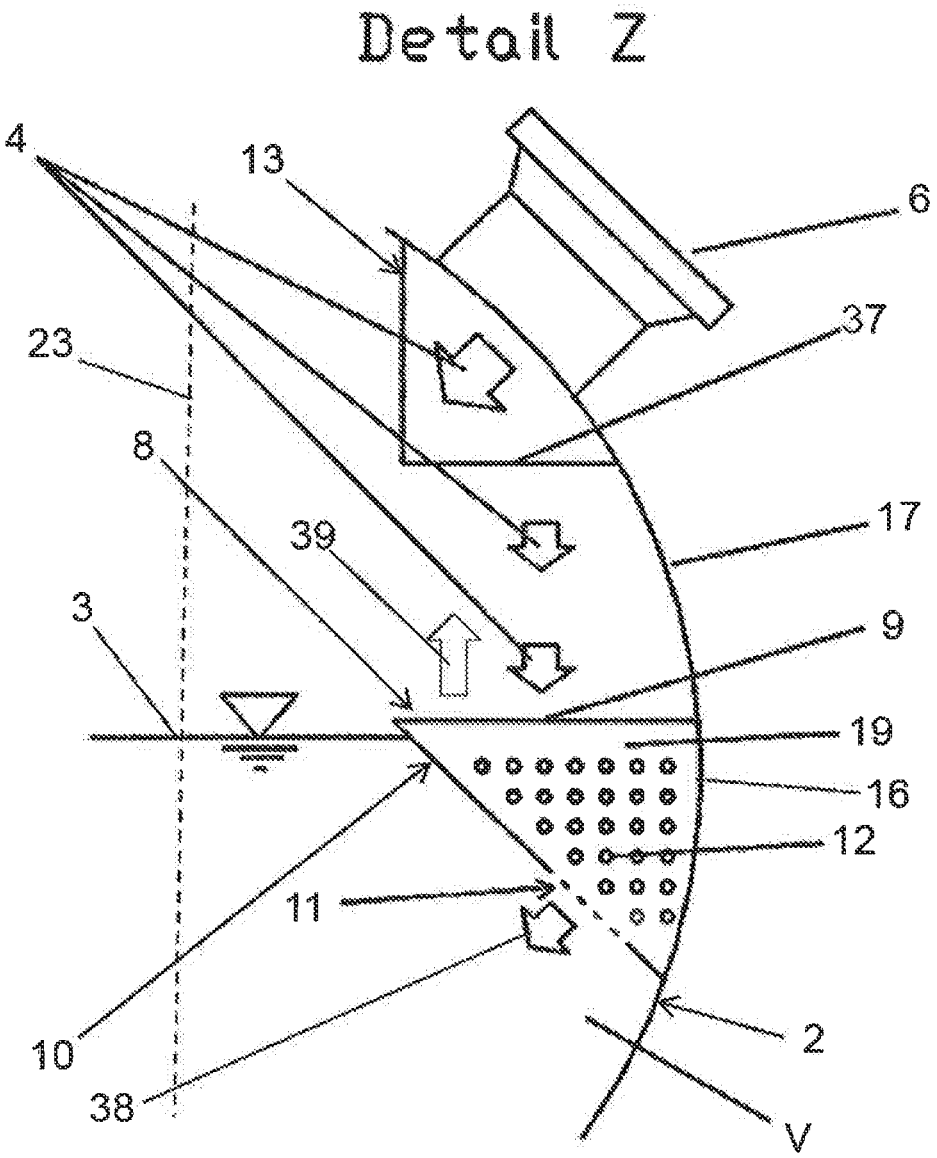
Figure 4:
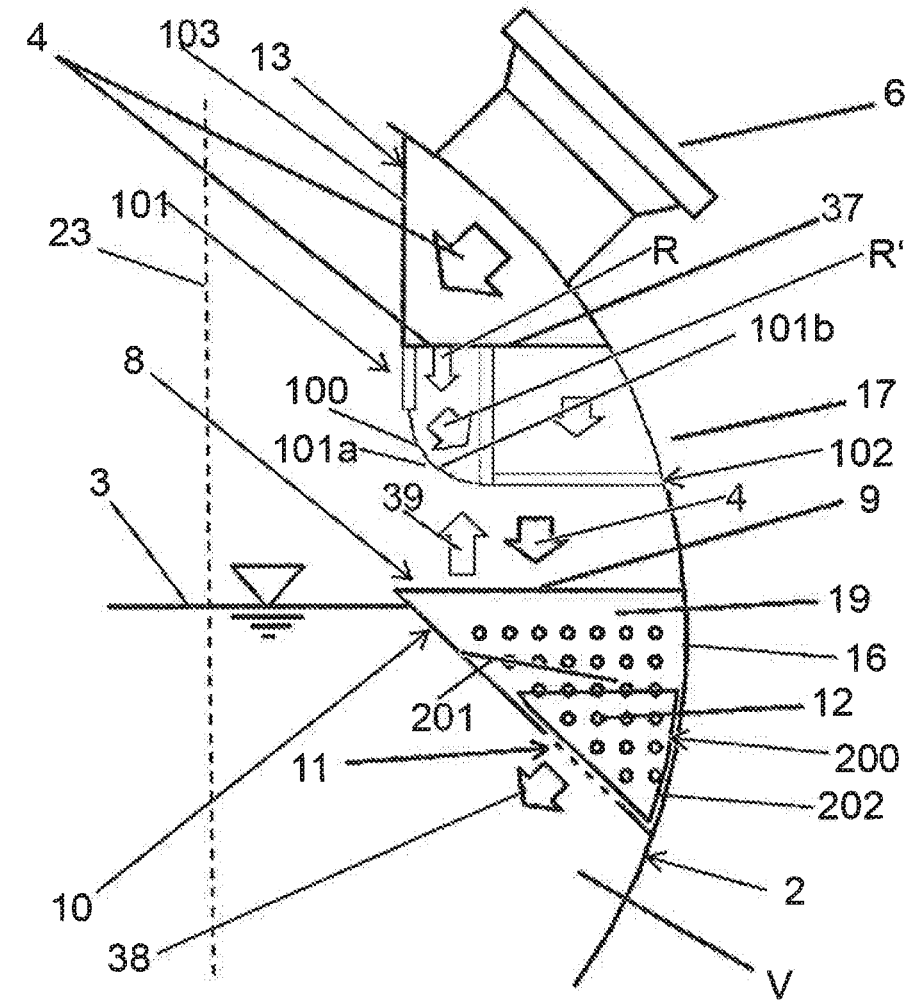

The invention described above is explained in detail below against the relevant technical background with reference to the associated drawings, which show preferred refinements. In the figures:

FIG. 1 shows an exemplary embodiment of a heat exchanger according to the invention in longitudinal section, FIG. 2 shows the exemplary embodiment according to FIG. 1 in cross section (along the line A-A), FIG. 3 shows a detail of the cross section of the heat exchanger that is shown FIG. 2, and FIG. 4 shows a detail of the cross section of a heat exchanger according to the invention that is shown in FIG. 2, a conducting device for conducting the liquid phase of the first medium being optionally present according to a further exemplary embodiment of the invention.

FIG. 1 shows in conjunction with FIGS. 2 and 3 a heat exchanger 1 according to the invention. It has a tank 2, which has a cylindrical shell 17, which extends along a longitudinal axis or cylinder axis, which in the case of a heat exchanger 1 arranged as intended, or during the operation of the unit 1, runs along the horizontal. The two ends of the shell 17 are adjoined by outwardly curved end plates 17*a*, 17*b*. The tank 2 surrounds an inner space or shell space I, in which at least one plate heat exchanger 5 is arranged. In the present case, two plate heat exchangers 5 are provided in the inner space I. Only one plate heat exchanger 2 is described below by way of example.

Provided on an upper region of the shell 17 of the tank 2 is an inlet 6 for a two-phase first medium 4, which is intended to be introduced into the inner space I of the tank 2, in order to form there a bath with a defined filling height 3 surrounding the plate heat exchanger 5. This region of the inner space I is also referred to as collecting space V. The region above the liquid bath with the filling height 3 is referred to as separating space A. This space A is available for receiving a gaseous phase 39 of the first medium 4 that is intended to be separated from the first medium. The filling height 3 is in particular dimensioned such that the plate heat exchanger 5 only protrudes out of the bath (first medium 4) with a horizontally extending upper side 28.

The inlet 6 for the first medium 4 is in flow connection with a distributor 13, which is formed as a channel that extends along the longitudinal axis of the shell 17. The distributor 13 is set against an inner side of the shell 17 that is facing the inner space I, so that part of the wall of the distributor 13 is formed by the shell 17 itself. The distributor 13 surrounds a distributor space 21, which is made to extend along the longitudinal axis of the shell 17 and has a predetermined distributor length 14 along the longitudinal axis of the shell 17. Arranged perpendicularly under the distributor 13 is a separating unit 8, which serves the purpose of stabilizing the first medium 4, so that a gaseous phase 39 of the first medium 4 can be separated in the separating unit 8 to the greatest extent from the liquid phase 38 of the first medium 4 before the liquid phase 38 is fed to the collecting space V. The relative position of the inlet 6, the distributor 13 and the separating unit 8 are represented in the lateral sectional view in FIG. 2 and FIG. 3. Represented in FIG. 2 is the position of a detail Z that is shown in FIG. 3. The position of the sectional view is denoted in FIG. 1 by A-A.

The distributor 13 has a base running horizontally along the longitudinal axis of the shell 17 with outlet openings in the form of through-openings 37, by way of which the first medium 4 introduced into the distributor space 21 over the entire length 14 of the distributor 13 or of the distributor space 21 can be passed into a receiving space 7 formed by the separating unit 8. The separating unit 8 has for this purpose an upwardly facing receiving opening 9, which is arranged under the distributor 13 and the opening plane of which extends perpendicularly to the vertical 23. By way of the receiving opening 9, the first medium 4, falling out of the distributor 13, passes into the receiving space 7. The separating unit 8 is in this case formed as an upwardly open channel, which extends under the distributor 13, likewise along the longitudinal axis of the shell 17, the separating unit 8 preferably having a length 15 along the longitudinal axis of the shell 17 that corresponds to the distributor length 14 along the longitudinal axis of the shell 17. The receiving space 7 of the separating unit 8 or the receiving opening 9 can therefore be charged with the first medium 4 over its entire length 15.

The separating unit 8 has a peripheral wall defining the receiving opening 9 and bounding the receiving space 7. The wall has in this case a first side wall 10, which is facing the inner space I or the plate heat exchanger 5 and lies opposite the plate heat exchanger 5 transversely to the longitudinal axis of the shell 17 in the horizontal direction. Lying opposite the first side wall 10 is a second side wall 16 of the separating unit 8, which is formed by the shell 17. At the end faces, the separating unit 8 has a third and a fourth side wall 19, 20, which extend perpendicularly to the longitudinal axis of the shell 17 and are formed substantially triangularly in a way corresponding to the cross-sectional shape of the separating unit 8 (apart from a rounding on account of the cylindrical shell 17). Correspondingly, the first side wall 10 of the separating unit 8 is inclined toward the plate heat exchanger 5, so that the horizontal cross section of the separating unit 8 or of the receiving space 7 increases vertically from the bottom upward toward the receiving opening 9. The first side wall 10 in the present case forms an angle of in particular 45° with the vertical.

Preferably, the separating unit 8 and/or the distributor 13 are formed by one or more metal sheets and are welded or connected in some other suitable way to the wall 17 of the tank 2. In particular, the first side wall 10 and also the third and fourth side walls 19, 20 may be respectively formed by a planar metal sheet and suitably connected to one another (for example by welded connections, riveted connections, etc.).

For letting the liquid phase 38 of the first medium 4 out of the receiving space 7 of the separating unit 8, the first side wall 10 has distributing openings 11. Furthermore, side openings 12 are provided in the end side walls 19, 20 in the form of through-openings, by way of which the liquid phase 38 of the first medium 4 can likewise leave into the collecting space V.

The wall of the separating unit 8 or the first, third and fourth side walls 10, 19, 20 define(s) an upper edge of the separating unit 8 that borders the receiving opening 9 and is preferably arranged above the filling height 3. Correspondingly, the liquid phase 38 of the first medium 4 preferably passes from the receiving space 7 into the collecting space V only by way of the distributing or side openings 11, 12.

According to FIG. 1, the distributing openings 11 are formed in a slit-shaped manner along the vertical 23. The distributing openings 11 are preferably arranged equidistantly from one another over the entire length 15 of the separating unit. According to FIGS. 2 and 3, the side openings 12 are preferably formed as circular holes, which respectively form a sufficient overall cross-sectional area for different filling levels in rows arranged one above the other parallel to the filling height 3. Preferably, the openings 11, 12 are all located under the filling height 3.

For drawing off the gaseous phase 39 of the first medium 4 from the separating space A, the tank 2 has at least one outlet nozzle 22 on an upper region of the shell 17. Furthermore, an outlet 36, which is intended for letting the liquid phase 38 of the first medium 4 out of the collecting space V, is provided on a lower region of the shell 17. By means of an overflow wall 35, a minimum filling height of the liquid phase 38 of the first medium 4 in the collecting space V is ensured.

In detail, the plate heat exchanger 5 has first heat exchanging passages 24 for the first medium 4 and also parallel second heat exchanging passages 25 for the second medium 4*a*. The heat exchanging passages 24, 25 are separated from one another by separating plates and preferably have heat conducting structures 26 (for example in the form of fins, in particular corrugated fins). The second heat exchanging passages 25 are closed off outwardly (i.e. toward the shell space I). For charging the second heat exchanging passages 25, an inlet 31 is provided on the shell 17 of the tank 2 and is in flow connection with a first manifold 31*a*, by way of which the individual second heat exchanging passages 25 can be charged with the second medium 4*a*. The plate heat exchanger 5 also has a second manifold 32*a*, which is in flow connection with an outlet 32 provided on the shell 17. By way of the second manifold 32*a*, the second medium 4*a* can be drawn from the second heat exchanging passages 25 and can be drawn off from the heat exchanger 1 by way of the outlet 32.

The first heat exchanging passages 24 are formed open to the upper side 28 of the plate heat exchanger 5 and also to an underside 29 of the plate heat exchanger 5 that is facing away from the upper side and have outlet or inlet openings 27, 28 there. The liquid phase of the first medium 4 can in this case enter the first heat exchanging passages 24 through the inlet openings 30 on the underside 29 and leave them again on the upper side 28 by way of the outlet openings 27.

During the operation of the heat exchanger 1, the first medium 4 or the fraction of the first medium 4 remaining after the partial separation of the gas phase 39 flows or falls out of the distributor space 21 of the distributor 13 by way of the receiving opening 9 into the receiving space 7 of the separating unit 8 and is caught there. The liquid phase 38 of the first medium 4 then passes through the distributing and possibly side openings 11, 12, which lie under the filling height 3 of the liquid bath, into the liquid bath in the collecting space V and enter there the first heat exchanging passages 24 by way of the inlet openings 30 on the underside 29 of the plate heat exchanger 5.

In the receiving space 7, the gaseous phase 39 of the first medium 4 that has entered rises up and leaves the receiving space 7 of the separating unit 8 into the separating space A by way of the receiving opening 9. From the separating space A, the gaseous phase 39 of the first medium 4 is drawn off by way of the at least one outlet nozzle 22. The two-phase first medium 4 is generally supplied continuously by way of the inlet 6 and the liquid phase 38 of the first medium 4 that is not required in this heat exchanger is discharged by way of the outlet 36, so that in particular a continuous cooling process can take place under defined conditions.

The liquid phase 38 of the first medium 4 enters the inlet openings 30 on the underside 29 and rises upwardly into the first heat exchanging passages 24 on account of the thermosiphon effect. At the same time, a second medium 4*a* is introduced into the adjoining second heat exchanging passages 25, so that heat is exchanged from the second medium 4*a* indirectly to the first medium 4. The first medium 4 thereby becomes warmer or partially evaporates and leaves from the outlet openings 27 of the first heat exchanging passages 24 on the upper side 28 of the plate heat exchanger 5, generally as a two-phase stream. The remaining liquid phase 38 of the first medium 4 then circulates again downwardly to the inlet openings 30, while the gaseous phase 39 rises up in the separating space A and is drawn off from the separating space A by way of the at least one outlet nozzle 22.

In the case of a further exemplary embodiment of the heat exchanger 1 according to the invention, as shown in FIG. 4, in a heat exchanger 1 of the type in FIGS. 1 to 3 a conducting device 100 which is designed for conducting the liquid phase 38 of the first medium 4 leaving the at least one outlet opening 37 is arranged under the distributor 13 in the vertical direction, the conducting device 100 in particular deflecting at least part of the liquid phase 38 that is leaving the at least one outlet opening 37 downwardly in a first (in particular vertical) spatial direction R into a second spatial direction R', which preferably differs from the first spatial direction R. Here, the second spatial direction R' has a greater horizontal component than the first spatial direction R. The deflection of at least part of the liquid phase 38 preferably takes place in this case such that the liquid phase 38 of the first medium 4 is conducted away from the upper side 28 or past the upper side 28 of the heat exchanger or plate heat exchanger 5. It is thereby ensured that the liquid phase 38 of the first medium 4 does not impinge on the upper side 28 of the at least one plate heat exchanger 5. For this purpose, the conducting device 100 has in particular at least one conducting element 101, in particular in the form of a baffle, which extends along the longitudinal axis of the tank 2 or shell 17 and in particular butts substantially flush against a vertical side wall 103 of the distributor channel that is facing the inner space I, or possibly goes over into it. However, between the distributor channel 13 or the vertical side wall 103 and the conducting element 101 there may also be provided a gap, which is made to extend along the longitudinal axis of the shell 17 or tank 2 and through which a gaseous phase 39 of the first medium 4 can pass into the separating space A.

The at least one conducting element 101 has in particular a curvature or inclination in such a way that the at least one conducting element 101 has a first side 101*a*, in particular a convexly curved first side 101*a*, which is facing the plate heat exchanger 5, and also a second side 101*b*, which is facing away from the first side 101*a*, is in particular concavely curved and is facing away from the plate heat exchanger 5 or facing the distributor 13. The at least one conducting element 101 is in this case thus arranged such that at least part of the liquid phase 38 of the first medium 4 that is leaving the distributor 13 through the at least one outlet opening 37 impinges on the second side 101*b* and is conducted along it away from the upper side 28 of the plate heat exchanger 5 and introduced into the bath laterally in relation to the at least one plate heat exchanger 5. The at least one conducting element 101 is preferably fixed both on the distributor 13 and on the shell 17 of the tank 2 by means of a frame 102.

Finally, in principle the separating unit 8 can have in all the embodiments a device 200 for conducting and/or controlling the liquid phase 38 in the receiving space 7, as shown by way of example in FIG. 4. The device 200 may for example have at least one conducting element or baffle 201 for deflecting and/or decelerating a flow of the liquid phase 38, or a mesh 202, in particular a wire mesh, which serves for decelerating a flow of the liquid phase 38 and/or for assisting the agglomeration of gas bubbles of an entrained gaseous phase in the receiving space 7.

FIG. 4 shows a possible form of such a device 200. The wire mesh is in this case arranged for example in the lower region of the receiving space 7. The conducting element or baffle 201 extends for example from the first side wall 10 above the distributing openings 11 in the direction of the opposite second side wall 16 or the shell 17. The baffle 201 consequently prevents a direct flow of the liquid phase 38 from forming in the receiving space 7 in the direction of the distributing openings 11. It is of course also possible if appropriate to dispense with the conducting device 201 or the mesh 202. The two components 201, 202 do not necessarily have to be combined. The arrangement of the conducting element 201 may be varied according to the flow that is present in the receiving space 7. The aim is in particular to suppress a direct throughflow of the liquid phase 38 to the distributing openings 11.

With the heat exchanger 1 proposed here, a gaseous phase 39 of the first medium 4 can be separated to the greatest extent from the liquid phase 38 of the first medium 4 before the liquid phase 38 is fed to the collecting space V, and also in particular better control and distribution of the liquid phase 38 of the first medium 4 can be achieved.

LIST OF DESIGNATIONS

| | |
|---|---|
| 1 | Heat exchanger |
| 2 | Tank |
| 3 | Filling height |
| 4 | First medium |
| 4a | Second medium |
| 5 | Plate heat exchanger |
| 6 | Inlet |
| 7 | Receiving space |
| 8 | Separating unit |
| 9 | Receiving opening |
| 10 | First side wall |
| 11 | Distributing opening |
| 12 | Side opening |
| 13 | Distributor |
| 14 | Distributor length |
| 15 | Length of separating unit |
| 16 | Second side wall |
| 17 | Shell |
| 17a, 17b | End plates |
| 19 | Third side wall |
| 20 | Fourth side wall |
| 21 | Distributor space |
| 22 | Outlet nozzle |
| 23 | Vertical |
| 24 | First heat exchanging passage |
| 25 | Second heat exchanging passage |
| 26 | Heat conducting structure |
| 27 | Outlet opening (of the plate heat exchanger) |
| 28 | Upper side |
| 29 | Underside |
| 30 | Inlet opening (of the plate heat exchanger) |
| 31 | Inlet for second medium |
| 31a | First manifold |
| 32 | Outlet for second medium |
| 32a | Second manifold |
| 35 | Overflow wall |
| 36 | Outlet or liquid outlet |
| 37 | Outlet openings or through-openings of the distributor |
| 38 | Liquid phase of the first medium |
| 39 | Gaseous phase of the first medium |
| 100 | Conducting device |
| 101 | Conducting element |
| 101a | First side |
| 101b | Second side |
| 102 | Frame |
| 103 | Side wall of the distributor |
| 200 | Device for conducting/controlling the liquid phase in the separating unit |
| 201 | Conducting element (for example baffle) |
| 202 | Mesh |
| A | Separating space |
| I | Inner space or shell space |
| R | First spatial direction |
| R' | Second spatial direction |
| V | Collecting space |

The invention claimed is:

1. A heat exchanger for indirectly exchanging heat between a first medium and a second medium comprising:

a tank, which has an inner space for receiving the two-phase first medium a plate heat exchanger arranged in the inner space, for indirectly exchanging heat between the first medium and the second medium, the inner space being designed to receive the first medium with a filling height such that a liquid phase of the first medium forms a bath surrounding the plate heat exchanger, and an inlet for introducing the first medium into the inner space, characterized in that a separating unit forming a receiving space is provided in the inner space for separating the gaseous phase from the liquid phase of the first medium, the separating unit having at least one upwardly directed receiving opening for introducing into the receiving space first medium falling down in the inner space, the upwardly directed receiving opening being arranged above the filling height or at the filling height, so that the gaseous phase of the first medium that is received in the receiving space can escape via the receiving opening into the inner space, and a distributor that is in flow connection with the inlet and is arranged vertically above the receiving opening and also above the filling height being provided in the inner space, the distributor being designed to distribute the first medium over the receiving opening.

2. The heat exchanger as claimed in claim 1, characterized in that the separating unit has a first side wall, which is in particular facing the inner space.

3. The heat exchanger as claimed in claim 2, characterized in that the first side wall has at least one distributing opening, the at least one distributing opening being arranged at least partially under the filling height, so that the liquid phase of the first medium can be introduced by way of the at least one distributing opening into the bath surrounding the plate heat exchanger.

4. The heat exchanger as claimed in claim 2, characterized in that the first side wall is formed as an overflow wall.

5. The heat exchanger as claimed in claim 1, characterized in that the distributor for distributing the first medium over the receiving opening has at least one downwardly directed outlet opening and also in particular a conducting device.

6. The heat exchanger as claimed in claim 2, characterized in that the separating unit has a second side wall, which lies opposite the first side wall and is particular formed by a wall or a shell of the tank.

7. The heat exchanger as claimed claim 1, characterized in that the separating unit has a third side wall and a fourth side wall opposite the third side wall, the third and fourth side walls respectively connecting the first and second side walls to one another and in particular being arranged perpendicularly in installation, and in particular the third and/or fourth side walls respectively being formed as an overflow wall.

8. The heat exchanger as claimed in claim 7, characterized in that the third and fourth side walls respectively have at least one side opening for letting out a liquid phase of the first medium, the respective at least one side opening being formed in particular as a circular hole.

9. The heat exchanger as claimed in claim 1, characterized in that the separating unit is open at both its end faces.

10. The heat exchanger as claimed in claim 2, characterized in that the first side wall is inclined toward the plate heat exchanger and forms an angle with the vertical in the range of 15° to 75°, in particular 45°.

11. The heat exchanger as claimed in claim 1, characterized in that the plate heat exchanger has first heat exchanging passages for the first medium and second heat exchanging passages for the second medium, the heat exchanging passages being separated from one another by separating plates, heat conducting structures being arranged in particular in the first and second heat exchanging passages, and in particular the plate heat exchanger having outlet openings on an upper side of the plate heat exchanger and also inlet openings on an underside of the plate heat exchanger, so that a liquid phase of the first medium surrounding the plate heat exchanger can pass by way of those inlet openings into the first heat exchanging passages and can rise up in the latter and also leave again from the outlet openings.

12. The heat exchanger as claimed in claim 5, characterized in that the heat exchanger 7 has a conducting device which is arranged under the distributor and is designed for conducting the liquid phase of the first medium that is leaving the at least one outlet opening.

13. The heat exchanger as claimed in claim 12, characterized in that the conducting device is designed to conduct at least part of the liquid phase that has left the at least one outlet opening in a first spatial direction into a second spatial direction, the second spatial direction in particular being different from the first spatial direction, and the second spatial direction in particular having a greater horizontal component than the first spatial direction, and the first spatial direction running in particular along the vertical from the top downward.

14. The heat exchanger as claimed in claim 1, characterized in that a device for conducting and/or controlling the liquid phase in the receiving space is provided in the receiving space of the separating unit, the device in particular having at least one of the following elements: a conducting element, in particular in the form of a baffle, for deflecting and/or decelerating a flow of the liquid phase, a mesh, in particular a wire mesh, for decelerating a flow of the liquid phase and/or for assisting the agglomeration of gas bubbles of an entrained gaseous phase.

15. The heat exchanger as claimed in claim 1, characterized in that the separating unit extends over more than half of the length of a shell of the tank in the inner space of the heat exchanger, preferably over more than 80% of this length, more preferably over more than 90% of this length.

* * * * *